United States Patent [19]

McMahon, Jr.

[11] 4,439,930

[45] * Apr. 3, 1984

[54] CONVEYOR DRYER AND METHOD OF OPERATION

[75] Inventor: Irven J. McMahon, Jr., Painesville, Ohio

[73] Assignee: The Coe Manufacturing Company, Painesville, Ohio

[ * ] Notice: The portion of the term of this patent subsequent to Aug. 5, 1997 has been disclaimed.

[21] Appl. No.: 291,485

[22] Filed: Aug. 10, 1981

Related U.S. Application Data

[63] Continuation-in-part of Ser. No. 231,274, Feb. 4, 1981, abandoned.

[51] Int. Cl.[3] ..... F26B 21/10

[52] U.S. Cl. ..... 34/15; 34/31; 34/34; 34/44; 34/48; 34/54; 34/216; 34/242; 34/51

[58] Field of Search ..... 34/66, 92, 210, 213, 34/214, 216, 242, 219, 155, 54, 51, 48, 44, 15, 31, 34

[56] References Cited

U.S. PATENT DOCUMENTS

| | | | |
|---|---|---|---|
| 3,259,995 | 7/1966 | Powischill | 34/54 |
| 3,299,533 | 1/1967 | Morris | 34/205 |
| 4,121,350 | 10/1978 | Buchholz | 34/219 |
| 4,215,489 | 8/1980 | McMahon, Jr. | 34/242 |

*Primary Examiner*—Larry I. Schwartz

*Attorney, Agent, or Firm*—Watts, Hoffmann, Fisher & Heinke

[57] ABSTRACT

A dryer for reducing the moisture content of material in sheet form comprising a drying chamber through which material to be dried is conveyed and through which heated air is recirculated being withdrawn from the material exit end thereof at less than atmospheric pressure and returned to the material feed end of the drying chamber by power driven fans. During its return to the material feed end of the drying chamber it is reheated. A supplemental gas chamber is provided at the feed end of the drying chamber for controlling the flow of gas from the material feed end of the drying chamber. A second supplemental gas chamber at the material exit end of the drying chamber has means for limiting the leakage of air at ambient temperature thereinto and is provided with an exhaust fan for withdrawing gas therefrom and in turn from the material exit end of the drying chamber. An instrumentality, preferably a temperature responsive instrumentality, associated with the supplemental gas chamber at the feed end of the drying chamber controls the amount of gas withdrawn from the supplemental gas chamber at the material exit end of the drying chamber and in turn the amount withdrawn from the material exit end of the drying chamber which in turn affects the flow of gas between the material feed end of the drying chamber and the supplemental gas chamber at the material feed end of the drying chamber.

11 Claims, 4 Drawing Figures

CONVEYOR DRYER AND METHOD OF OPERATION

CROSS REFERENCE TO RELATED APPLICATION

This application is a continuation-in-part of co-pending application Ser. No. 231,274 filed Feb. 4, 1981 now abandoned.

BACKGROUND OF THE INVENTION

1. Field of the Invention

The invention relates to apparatus for drying material utilizing force circulated heated gas in contact with the material to be dried conveyed through a linear conduit section of the gas system and to a method of operating such an apparatus.

2. Description of the Prior Art

Single and multiple deck conveyor dryers for reducing the moisture content of various materials including rigid and semi-rigid material in sheet form, such as, green veneer, wet plasterboard, fiberboard , Perlite and bagasse mat, and the like, wherein the material being dried is conveyed through a stationary housing on one or a plurality of tiered conveyors while heated gasses are force circulated through the housing or a part thereof are known. The increase in volume of the gas in the gas system incident to the evaporation of moisture from the material being dried is typically removed by pre-set vents in the conduit or duct by which the gas is returned from the material exit end fo the material feed end of the dryer. One of the principal disadvantages of these dryers is loss of efficiency because of the lack of control of the amount of gas exhausted through the vents in the gas return conduit as conditions in the drying chamber or section of the dryer varies. Supplemental gas chambers have been employed at the material exit ends of drying chambers to withdraw gas from the material exit ends thereof and prevent the entrance of air at ambient temperature into the dryer chamber through the material exit openings in the dryer. The dryer and method of operation of the present invention provides greater efficiency than prior art dryers by withdrawing the increased gas in the gas system resulting from the evaporation of moisture from the material being dried, and products of combustion when applicable, at the lowest temperature point in the drying process.

Roll conveyors are typically employed in dryers of the type with which the present invention is particularly concerned. Single roll conveyors are usually employed in so-called "board" dryers used in the manufacture of such products as fiberboard, plasterboard, and the like, and double or pinch roll conveyors are typically employed in so-called "veneer" dryers because veneer tends to warp upon drying.

SUMMARY OF THE INVENTION

The present invention provides a dryer for reducing the moisture content of material wherein hot gasses are circulated from the material feed or "wet" end to the material exit or "dry" end of a material drying chamber from which "dry" end of the drying chamber they are withdrawn at pressures less than atmospheric, reheated and returned to the "wet" end. A supplemental gas chamber is provided at the material exit end of the drying chamber with means at its material exit end for restricting the flow or leakage of air at ambient temperature thereinto. The supplemental chamber at the material exit end of the drying chamber is provided with means for withdrawing gas therefrom. A condition, for example, temperature, pressure, humidity, etc., of the gas at the material feed end of the drying chamber if monitored and is used to control the amount of gas discharged or withdrawn from the supplemental chamber at the material exit end of the drying chamber and in turn the amount of gas withdrawn from the material exit end of the drying chamber to maintain a predetermined gas condition at the material feed end of the drying chamber. The amount of volume of gas withdrawn from the supplemental chamber at the material exit end of the drying chamber preferably is the increase in volume of gas in the gas system incident to evaporation of moisture as the material being dried dries and from products of combustion when the drying chamber is heated by direct firing.

According to another aspect of the invention a dryer is provided for reducing the moisture content of material wherein hot gasses are circulated from the material feed or "wet" end to the material exit or "dry" end of a material drying chamber from which "dry" end of the drying chamber they are withdrawn at pressures less than atmospheric, reheated and returned to the "wet" end. Supplemental gas chambers are provided at both ends of the drying chamber. The supplemental gas chamber at the feed end of the drying chamber may be provided with means controlling the entrance of air at ambient temperature into the material feed end thereof through the material feed openings therein. Means may also be provided at the material exit end of the supplemental gas chamber at the material feed end of the drying chamber or at the material feed end of the drying chamber for restricting the flow of gas between the material exit end of the supplemental gas chamber at the material feed end of the drying chamber and the material feed end of the drying chamber. The supplemental gas chamber at the material exit end of the drying chamber is provided with means at its material exit end for restricting or limiting the flow or leakage of air at ambient temperature thereinto and may be provided with means at its material feed end for controlling the flow of gas thereinto from the material exit end of the drying chamber. The supplemental gas chamber at the material exit end of the drying chamber is provided with means for withdrawing gas therefrom and the supplemental gas chamber at the material feed end of the drying chamber is preferably provided with a means for withdrawing gas therefrom. A condition, preferably the temperature, of the gas in the supplemental gas chamber at the material feed end of the drying chamber is monitored and is used to control the amount of gas discharged or withdrawn from the supplemental gas chamber at the material exit end of the drying chamber to maintain a predetermined condition in the supplemental gas chamber at the material feed end of the drying chamber. This condition is preferably a gas temperature slightly above ambient temperature and serves to control the amount or volume of gas withdrawn from the supplemental gas chamber at the material exit end of the drying chamber. The amount withdrawn is preferably the increase in volume of gas in the gas system incident to evaporation of moisture as the material being dried dries and products of combustion if present. This is automatically achieved because any such increase in gas volume results in a flow of the heated gas into the supplemental gas chamber at the entrance end, raising the temperature and causing withdrawal of gas from the chamber at the exit end until the monitored temperature is lowered.

According to a further aspect, the invention provides a method of drying material in a drying chamber having material feed and discharge ends through which heated gas is circulated from the feed end to the exit end and a portion thereof returned from the exit end to the feed end for recirculation through the drying chamber, and which dryer has a supplemental gas chamber at the material exit end of the drying chamber provided with means restricting the flow of air at ambient temperature into the exit end thereof, which method includes monitoring a condition of the gas in the dryer at or adjacent to the material feed end of the drying chamber to control the volume of gas exhausted from the supplemental chamber at the material exit end of the drying chamber to maintain a predetermined gas condition at or adjacent to the material feed end of the drying chamber and a gas pressure in the supplemental chamber less than atmospheric pressure and less than the subatmospheric gas pressure in the material exit end of the drying chamber to exhaust the increased gas volume in the gas system incident to the evaporation of moisture from the material being dried and from products of combustion when the drying chamber heat is derived by direct firing.

DESCRIPTION OF THE PREFERRED EMBODIMENT

Figure 1:
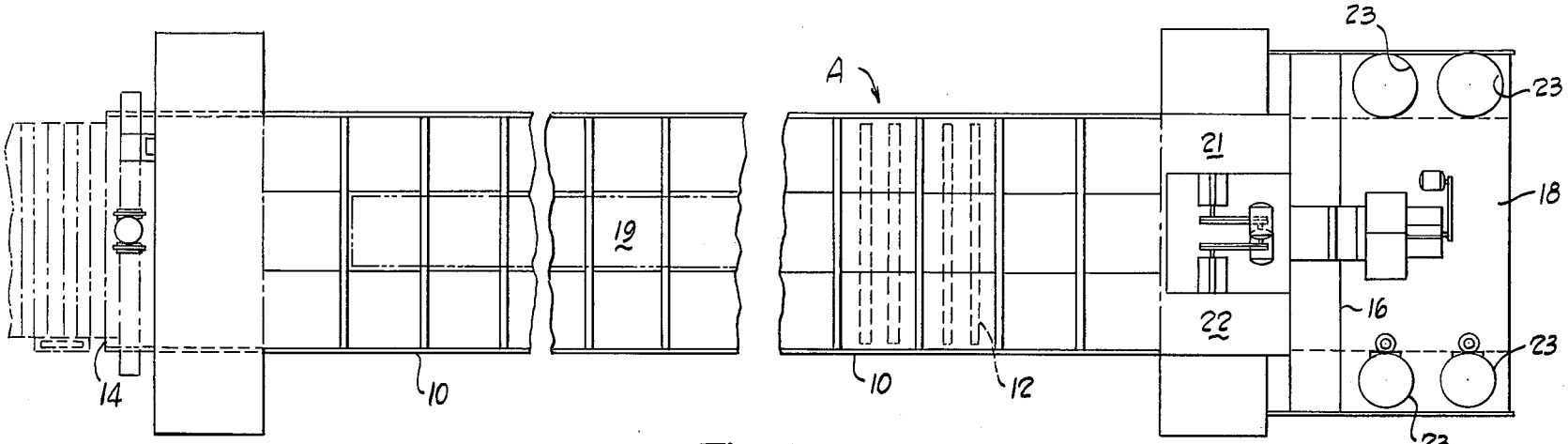
FIG. 1 is a fragmentary plan view of a dryer embodying the present invention.
Figure 2:
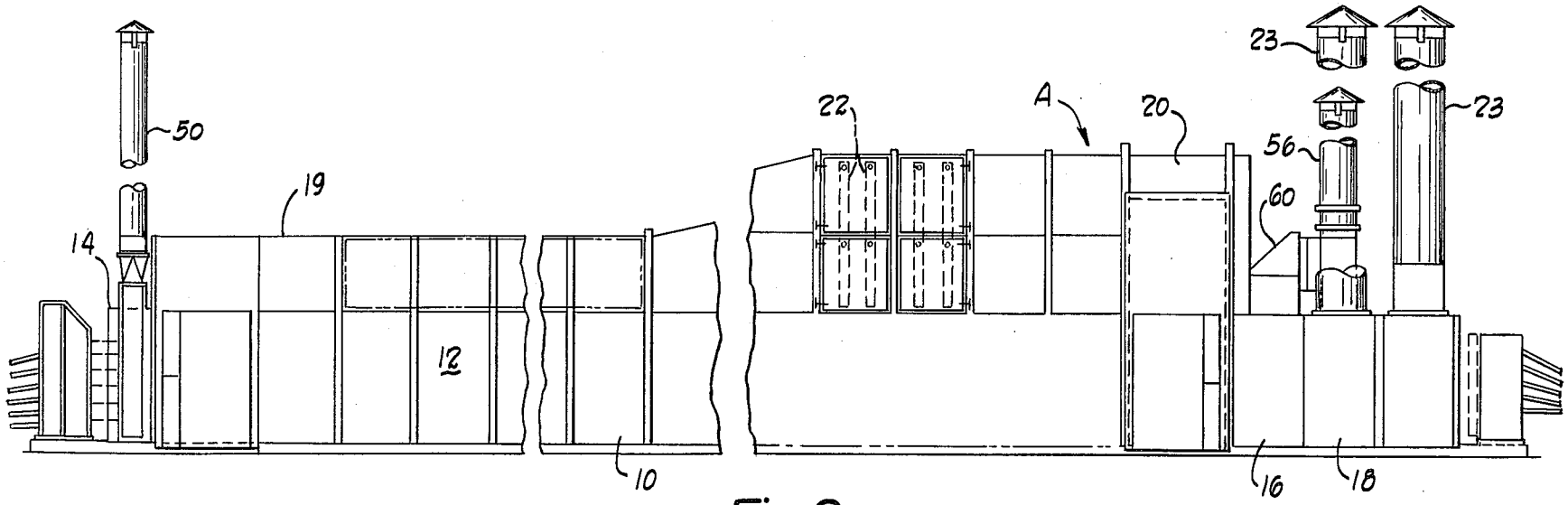
FIG. 2 is a fragmentary side elevation view of the apparatus shown in FIG. 1.
Figure 3:
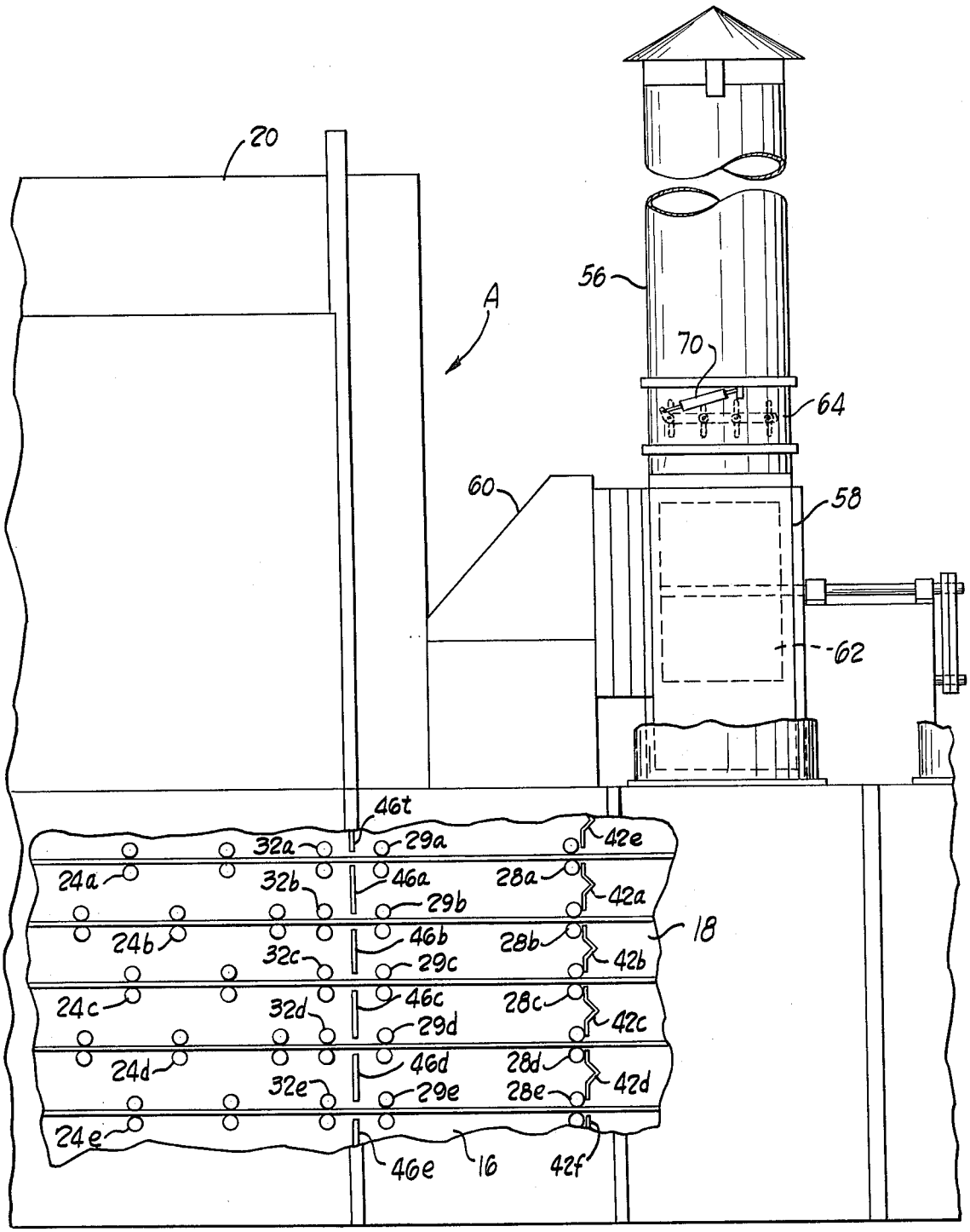
FIG. 3 is an enlarged view of a portion of FIG. 2.
Figure 4:
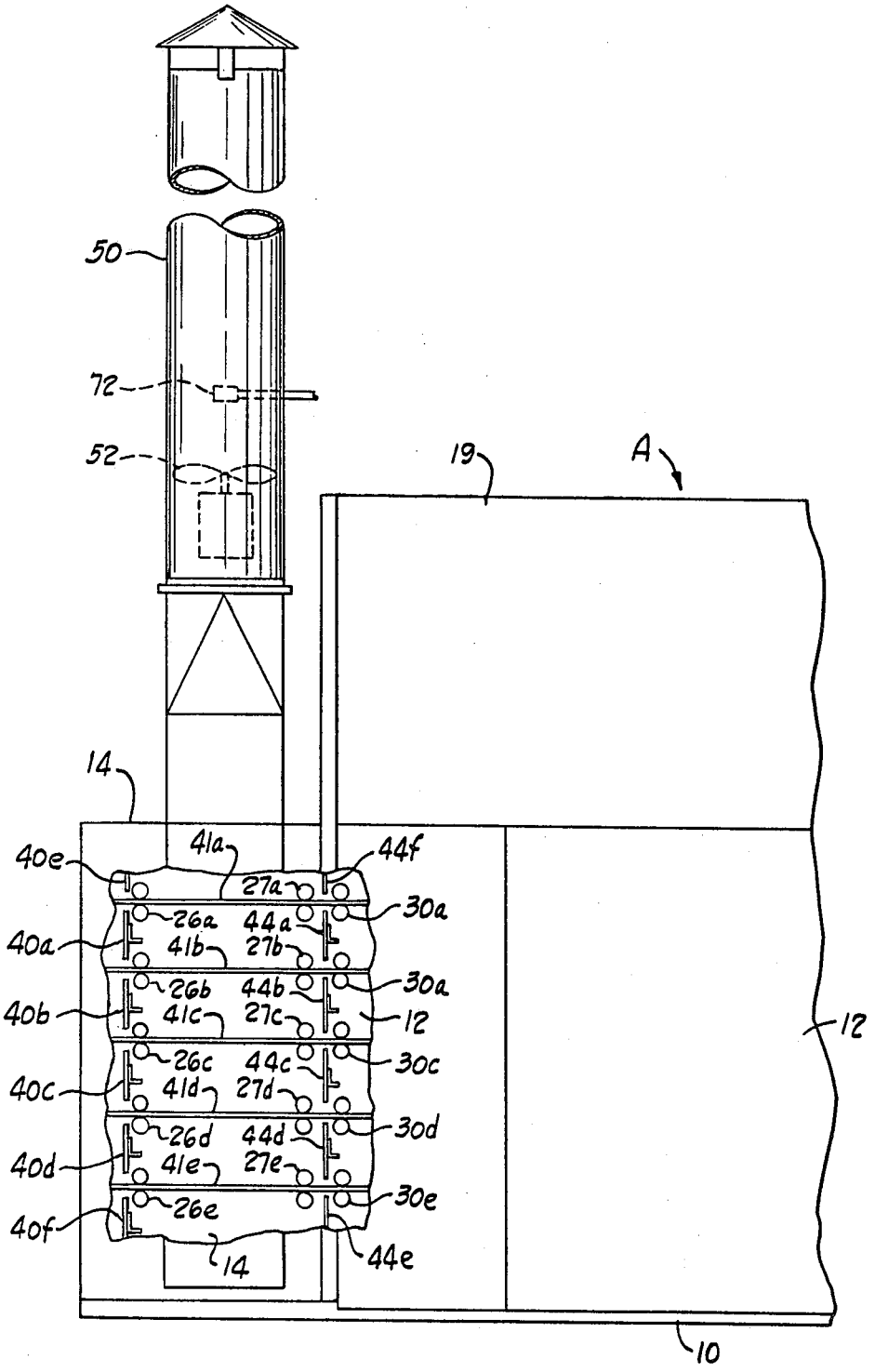
FIG. 4 is an enlarged view of a portion of the apparatus shown in FIG. 2.

Although the invention is applicable to various types of dryers including "board" dryers, it is herein shown and described as embodied in a horizontal gas flow multiple deck double or pinch roll conveyer type single gas system veneer dryer in which the flow of drying gas in the material drying chamber or zone is from the material entrance or feed end to the material discharge or exit end of the drying chamber or chambers, that is, from the "wet" end to the "dry" end, with the primary exhaust of all gasses and vapors withdrawn from the gas system being at the "dry" end of the drying chamber through a supplemental gas chamber thereat.

The exemplary drying apparatus shown in the drawings designated generally by the reference character A and comprises elongated horizontal housing 10 comprising a drying chamber or zone 12, a material feed end supplemental gas chamber or zone 14 at the material feed end of the drying chamber 12 and a material exit end supplemental gas chamber or zone 16 at the material exit end of the drying chamber 12 followed by a material cooling chamber or zone 18 the latter of which is of conventional construction. With the exception of the chambers or zones 14, 16 including certain devices including controls associated therewith and the omission of the vent in the gas return duct or conduit, and some changes in the housing which are unimportant to the present invention, the dryer A is similar to the single gas system dryer disclosed in U.S. Pat. No. 3,299,533, to Morris, the disclosure of which is incorporated herein by reference, and will not be described in detail.

In the present depicted dryer the drying gasses are circulated through the gas system including the drying chamber 12 and a gas return duct 19 above the drying chamber by centrifugal type fans located in the fan housings 20, 21 above the material exit end of the drying chamber and while returning to the material entrance end of the drying chamber the gas is reheated by heaters 22 in the duct 19. The reference character 23 designates air circulating vents and stacks in the cooling chamber or zone 18.

The material conveying pinch roll type endless conveyors, of which there are five (5) in the depicted dryer, are located one above the other, that is, tiered, extend through the housing 10, and are designated generally by the reference characters 24*a* to 24*e*. The chamber 14 has vertically aligned pairs of pinch rolls 26*a* to 26*e* at the material feed end thereof and vertically aligned pairs of pinch rolls 27*a* to 27*e* at its material exit end. The chamber 16 has vertically aligned pairs of pinch rolls 28*a* to 28*e* at its material exit end and vertically aligned pairs of pinch rolls 29*a* to 29*e* at the material feed end thereof. Pairs of pinch rolls 30*a* to 30*e* and 32*a* to 32*e* at the material feed and exit ends, respectively, of the drying chamber 12 are preferably vertically aligned. The arrangements of the other pinch rolls are a matter of choice.

The reference characters 40*a* to 40*f* represent stop-offs or baffles between the pairs of pinch rolls 26*a* to 26*e* of the respective material paths 41*a* to 41*e* at the material feed end of the chamber 14 and the top and bottom paths and the upper and lower parts of the housing 10. The baffles 40*a* to 40*f* are spaced from the rolls and allow restricted leakage or entrance of air at ambient temperature into the chamber 14 through the material feed end thereof, sufficient to avoid too low a pressure in the chamber 14 during operation of the dryer. Baffles or stop-offs 42*a* to 42*f* between the pairs of pinch rolls 28*a* to 28*e* of the respective material paths at the material discharge end of the chamber 16 and adjacent top and bottom paths at the upper and lower parts of the housing are provided to restrict the leakage or entrance of air at ambient temperatures into the chamber 16 through the material exit end thereof. The baffles 42*a* to 42*f* engage the roll adjacent thereto and provide fairly effective seals against the passage of air from one side of the pinch rolls to the other. In the depicted dryer stop-offs or baffles are shown at the material feed and discharge ends of the drying chamber 12 to restrict the flow of gas therethrough. These stop-offs or baffles at the material feed and exit ends of the drying chamber are indicated by the reference characters 44*a* to 44*f* and 46*a* to 46*f*, respectively. These baffles are of the type used at the material feed end of the chamber 14 and are not as critical or important as the baffles 42*a* to 42*f* at the material exit end of chamber 16.

The supplemental gas chamber or zone 14 is provided with a gas vent stack 50 provided with a power driven fan 52 therein for withdrawing gas from the chamber 14. The chamber 16 is provided with a gas vent stack 56 connected to a fan housing 58 and which in turn is connected to the chamber 16 by a duct 60. The housing 58 houses a centrifugal type fan 62 for withdrawing gas from the chamber 16. The stack 56 is provided with a damper 64 for controlling the volume of gas exhausted through the stack 56 by the fan 62 in the fan housing 58. During operation of the depicted dryer the fans connected with the chambers 14 and 16 are preferably driven at predetermined constant speeds. The speed of the fan 52 associated with the chamber 14 is adjustable to deliver a selected volume of gas per unit of time from the chamber 14. The damper 64 associated with the chamber 16 is positioned or adjusted to maintain a predetermined condition in the chamber 14, in the depicted dryer a predetermined temperature slightly greater than ambient temperature, by an electric linear actuator 70 designed to provide remote automatic proportional control, such as, a DL66 D362E11 P1 linear actuator marketed by International Telephone and Telegraph Corp., 320 Park Avenue, New York, N.Y. 10022. In the depicted dryer the position of the damper 64 is controlled from a sensor responsive to the temperature of the gas in the chamber 14, such as, a thermocouple 72 in the stack 50 thereof, connected to the linear actuator 70 by commercially available control equipment including a temperature control device located in a main electric control panel, such as a DialaTrol temperature controller marketed by Honeywell, Inc., Minneapolis, Minn. The predetermined temperature is maintained by causing more or less gas to be exhausted from the chamber 16 through the stack 56 thereof, at the material exit end of the drying chamber. Control equipment of the character referred to is commercially available and is not therefore herein described in detail.

Assuming that the gas pressures prevailing across the drying chamber or zone 12 in the vicinity of the wet end chamber 14 is below atmospheric pressure, preferably only slightly below atmospheric pressure, heated gas will leak or flow from the drying chamber 12 into the chamber 14 which is preferably slightly below the subatmospheric gas pressure in the vicinity of the material feed end of the drying chamber 12. The heated gas in the chamber 14 being received from the drying chamber mixes with air at ambient temperature entering the chamber 14 through the material feed end thereof to provide a temperature in the chamber 14 which is preferably slightly above ambient temperature. Air at ambient temperature is thus prevented from entering the drying chamber 12 at the feed end thereof which air if permitted to enter the drying chamber would cool the gas in the drying chamber thus reducing the efficiency of the dryer. Only a small controlled amount of heated gas flows into the chamber 14 to maintain the aforementioned temperature therein.

As the gas pressure in the feed end of the drying chamber 12 rises and falls the volume of heated gas entering the chamber 14 varies accordingly and the temperature in the chamber 14 will rise or fall, respectively. If the pressure rises, increased flow of heated gas from the drying chamber into the chamber 14 will increase the temperature in the chamber 14, which will be sensed by thte thermocouple 72. This will cause the linear actuator 70 to reposition the damper 64 in the stack 56 of the chamber 16 to increase the opening of the damper and in turn increase the flow of gasses from the chamber 16 thus reducing the pressure in the chamber 16, causing more gas to be drawn into the chamber 16 from the drying chamber 12 thus reducing the volume of gas in the gas system and the gas pressure at the material feed end of the drying chamber until the optimum temperature mentioned above (and, hence, optimum pressure) is restored to the feed end chamber 14. If the temperature of the gas in the feed end chamber 14 drops below the optimum temperature mentioned above the reverse takes place. The gas pressure in the chamber 16 normally is less than the subatmospheric pressure at the material exit end of the drying chamber 12, as the primary exhaust of all gasses and vapors from the dryer are through the material exit end of the drying chamber and the chamber 16.

As indicated, the gas pressure at the material feed end of the drying chamber 12 may be slightly positive or negative, that is, either slightly above or below atmospheric pressure or may fluctuate between positive and negative. The fan 52 in the chamber 14 has sufficient capacity to maintain a gas pressure in the chamber 14 less than the pressure of the gas in the feed end of the drying chamber 12 so that under all operating conditions a limited amount of heated gas is caused to flow from the material feed end of the drying chamber 12 to the chamber 14.

In the depicted dryer the volume of gas exhausted through the stack 56 is controlled by a damper 64, but it is to be understood that this could be accomplished in other ways, for example, by using a variable speed motor to drive the fan 62.

From the foregoing description of the preferred embodiment of the invention it will be apparent that the objects heretofore enumerated have been accomplished and that the present invention provides a novel dryer and method of operating dryers which prevents the ingress of air at ambient temperature into the material feed end of the drying chamber as well as the material exit end of the drying chamber while automatically withdrawing the increase of gas in the gas system incident to the drying of the material being processed from the dryer at the lowest temperature location in the gas system, all of which increases the efficiency of the dryer. While the preferred embodiment of the invention has been illustrated and described in detail it is to be understood that the invention is not limited thereto. Sensors, for example, other than the thermocouple shown located in the stack of the supplemental chamber at the feed of the drying chamber can be employed to sense temperatures or other conditions, such as, pressure, humidity, etc. existing at or up stream of the material feed end of the drying chamber and to control the volume of gas being exhausted from the dryer down stream from the drying chamber, if desired, and it is the intention to hereby cover all adaptations, modifications and uses of the invention which come within the practice of the art to which the invention relates and the scope of the appended claims.

I claim:

1. In a dryer for reducing the moisture content of material in sheet form comprising an elongated generally horizontal stationary housing having material entrance and discharge ends, a continuous conveyor extending through said housing which includes a material drying chamber intermediate its ends and through which said conveyor extends, means externally of said drying chamber for recirculating gas lengthwise through said drying chamber in the direction in which the material is conveyed through said drying chamber and maintaining a gas pressure less than atmospheric in the material exit end of said chamber, means for heating the gas, a supplemental gas chamber at the material exit end of said drying chamber, means restricting entrance of air into the material exit end of said supplemental chamber, power actuated means connected to said supplemental chamber for exhausting gas therefrom, and means responsive to a condition in the dryer at the material feed end of said drying chamber for controlling the amount of gas exhausted from said supplemental chamber whereby a predetermined condition is maintainable in the dryer at the material feed end of said drying chamber and the gas pressure in said supplemental chamber may be maintained at a pressure less than that of the subatmospheric gas pressure in the material exit end of said drying chamber.

2. In a dryer for reducing the moisture content of material in sheet form comprising an elongated generally horizontal stationary housing having material entrance and discharge ends, a continuous conveyor extending through said housing which includes a material drying chamber intermediate its ends and through which said conveyor extends, means externally of said drying chamber for recirculating gas lengthwise through said drying chamber in the direction in which the material is conveyed through said drying chamber and maintaining a gas pressure less than atmospheric in the material exit end of said chamber, means for heating the gas, a first supplemental gas chamber at the material feed end of said drying chamber, a second supplemental gas chamber at the material exit end of said drying chamber, means restricting entrance of air into the material exit end of said second chamber, power actuated means connected to said second chamber for exhausting gas therefrom, and means in said first supplemental chamber responsive to a condition therein for controlling the amount of gas exhausted from said second supplemental chamber by said power actuated exhaust means thereof whereby a predetermined condition is maintainable in said first supplemental chamber and the gas pressure in said second supplemental chamber is maintainable at a pressure less than the subatmospheric gas pressure in the material exit end of said drying chamber.

3. In a dryer for reducing the moisture content in sheet form comprising an elongated generally horizontal stationary housing having material entrance and discharge ends, a continuous conveyor extending through said housing for conveying material to be processed through the housing which includes a material drying chamber intermediate its ends and through which the conveyor extends, means externally of the drying chamber for recirculating gas lengthwise through said drying chamber in the direction in which the material is conveyed therethrough and maintaining a gas pressure less than atmospheric in the material exit end of said drying chamber, means for heating the gas, a first supplemental gas chamber at the material feed end of said drying chamber, means adjacent to the material feed end of said first supplemental chamber for controlling flow of air into said first supplemental chamber, a second supplemental gas chamber at the material exit of said drying chambers, means restricting entrance of air into the material exit end of said second supplemental chamber, an exhaust fan connected to said second supplemental chamber, means in said first supplemental chamber for sensing a condition therein and for controlling the amount of gas exhausted from said second supplemental chamber by said exhaust fan whereby a predetermined condition is maintainable in said first supplemental chamber and a gas pressure in said second supplemental chamber is maintainable less than that of the subatmospheric gas pressure in the material exit end of said drying chamber.

4. In a dryer for reducing the moisture content of material in sheet form comprising an elongated generally horizontal stationary housing having material entrance and discharge ends, a continuous conveyor extending through said housing which includes a material drying chamber intermediate its ends and through which said conveyor extends, means externally of said drying chamber for recirculating gas lengthwise through said drying chamber in the direction in which the material is conveyed through said drying chamber and maintaining a gas pressure less than atmospheric in the material exit end of said chamber, means for heating the gas, a supplemental gas chamber at the material exit end of said drying chamber, means restricting entrance of air into the material exit end of said supplemental chamber, power actuated means connected to said supplemental chamber for exhausting gas from said supplemental chamber, and means including a temperature instrumentality up stream from said drying chamber for controlling the amount of gas exhausted from said supplemental chamber by said power actuated exhaust means whereby a predetermined temperature may be maintained in the dryer up stream from said drying chamber and the gas pressure in said supplemental chamber may be maintained at a pressure less than that of the subatmospheric gas pressure in the material exit end of said drying chamber.

5. In a dryer for reducing the moisture content of material in sheet form comprising a horizontal stationary housing having material entrance and discharge ends, a continuous conveyor extending through the housing for conveying material to be processed through said housing which includes a material drying chamber intermediate its ends and through which said conveyor extends, means externally of said drying chamber for recirculating gas lengthwise therethrough in the direction in which the material is conveyed through said drying chamber and maintaining a gas pressure less than atmospheric in the material exit end of said drying chamber, means for heating the gas, a first supplemental gas chamber adjacent to the material feed end of said drying chamber, a second supplemental gas chamber at the material exit end of said drying chamber, means restricting entrance of air into the material exit end of said second supplemental chamber, an exhaust fan connected to said second supplemental chamber, a temperature responsive instrumentality in said first supplemental chamber for controlling the amount of gas discharged from said second supplemental chamber by said exhaust fan whereby a predetermined temperature may be maintained in said first supplemental chamber and the gas pressure in said second supplemental chamber may be maintained less pressure than that of the subatmospheric gas pressure in the material exit end of said drying chamber.

6. In a dryer for reducing the moisture content of material in sheet form comprising a horizontal stationary housing having material entrance and discharge ends, a continuous conveyor extending through the housing for conveying material to be processed through said housing which includes a material drying chamber intermediate its ends and through which said conveyor extends, means externally of said drying chamber for recirculating gas lengthwise therethrough in the direction in which the material is conveyed through said drying chamber and maintaining a gas pressure less than atmospheric in the material exit end of said drying chamber, means for heating the gas, a first supplemental gas chamber adjacent to the material feed end of said drying chamber, means adjacent to the feed end of said first supplemental chamber for controlling the entrance of air thereinto, a second seupplemental gas chamber at the material exit end of said drying chamber, means restricting entrance of air into the material exit end of said second supplemental chamber, an exhaust fan connected to said second supplemental chamber, means including a thermocouple in said first supplemental chamber for controlling the amount of gas discharged from said second supplemental chamber by said exhaust fan whereby a predetermined temperature may be maintained in said first supplemental chamber and the gas pressure in said second supplemental chamber may be maintained less than that of the subatmospheric gas pressure in the material exit end of said drying chamber.

7. In apparatus for reducing the moisture content of material in sheet form comprising an elongated generally horizontal stationary housing having material entrance and discharge ends, a continuous conveyor extending through said housing for conveying material to be processed through said housing which includes a material drying chamber intermediate its ends and through which the conveyor extends, means externally of the drying chamber for recirculating gas lengthwise through said drying chamber in the direction in which the material is conveyed through said drying chamber and maintaining a gas pressure less than atmospheric in the material exit end of said drying chamber, means for heating the gas, a first gas supplemental chamber including a vent stack adjacent to the material feed end of said drying chamber, a second gas supplemental chamber at the material exit of said drying chamber, said conveyor having pinch rolls at least at the material exit end of said second supplemental chamber, means adjacent to said pinch rolls at the material exit end of said second supplemental chamber for restricting entrance of air into the material exit ends of said second supplemental chamber, a power driven exhaust fan connected to said second supplemental chamber, means including a control instrumentality in said stack of said first supplemental chamber and responsive to a condition therein for controlling the amount of gas discharged from said second supplemental chamber by said exhaust fan whereby a predetermined condition is maintainable in said first supplemental chamber exhaust stack and the gas pressure in said second supplemental chamber may be maintained less than the subatmospheric gas pressure in the exit end of said drying chamber.

8. A method of drying material which comprises providing a drying chamber with product feed and exit ends, means for circulating a gas through the drying chamber from the feed end to the exit end and returning a portion of the gas from the exit end to the feed end for recirculating through the drying chamber, heating the gas in its return from the exit end of the drying chamber to the feed end thereof, providing a supplemental gas chamber at the exit end of the drying chamber having means for restricting the entrance of air at ambient temperature thereinto through the material exit end thereof, sensing a condition at the material feed end of the drying chamber and thereby controlling the exhaust of gas from the supplemental chamber at the material exit end of the drying chamber to maintain a predetermined condition at the material feed end of the drying chamber and a gas pressure in said supplemental chamber less than atmospheric pressure and less than the subatmospheric gas pressure in the material exit end of the drying chamber such that the primary exhaust of gas and moisture from the drying chamber is through said supplemental chamber.

9. A method of drying material which comprises providing a drying chamber with product feed and exit ends, means for circulating a gas through the drying chamber from the feed end to the exit end and returning a portion of the gas from the exit end to the feed end for recirculating through the drying chamber, heating the gas in its return from the exit end of the drying chamber to the feed end thereof, providing a supplemental gas chamber at the feed end of the drying chamber, providing a supplemental gas chamber at the exit end of the drying chamber having means for restricting the entrance of air at ambient temperature thereinto through the material exit end thereof, sensing a condition at the material feed end of the drying chamber and thereby controlling the exhaust of gas from the supplemental chamber at the material exit end of the drying chamber to maintain a predetermined condition at the material feed end of the drying chamber and a gas pressure in the supplemental chamber at the exit end of the drying chamber less than the subatmospheric gas pressure in the material exit end of the drying chamber such that the primary exhaust of gas and moisture from the drying chamber is through said supplemental chamber at the exit end of the drying chamber.

10. A method of drying material which comprises providing a drying chamber with product feed and exit ends, means for circulating a gas through the drying chamber from the feed end to the exit end and returning a portion of the gas from the exit end to the feed end for recirculating through the drying chamber, heating the gas in its return from the exit end of the drying chamber to the feed end thereof, providing a supplemental gas chamber at the feed end of the drying chamber having means at the material feed end thereof for controlling the flow of gas therethrough, providing a supplemental gas chamber at the exit end of the drying chamber having means for restricting the entrance of air at ambient temperature thereinto through the material exit end thereof, sensing a condition of the gas in the supplemental chamber at the material feed end of the drying chamber and thereby controlling the exhaust of gas from the supplemental chamber at the material exit end of the drying chamber to maintain a predetermined condition in the supplemental chamber at the material feed end of said drying chamber and a gas pressure in the supplemental chamber at the material exit end of said drying chamber less than the subatmospheric gas pressure in the material exit end of the drying chamber such that the primary exhaust of gas and moisture from the drying chamber is through said supplemental chamber at the material exit end of said drying chamber.

11. The method of drying material as defined in claim 10 wherein the temperature in the supplemental chamber at the material feed end of the drying chamber is sensed and the volume of gas exhausted from the supplemental chamber at the material exit end of the drying chamber is controlled in response thereto to maintain a temperature in the supplemental chamber at the material feed end of the drying chamber slightly above ambient temperature.

* * * * *